US009747877B2

(12) United States Patent
Lee

(10) Patent No.: US 9,747,877 B2
(45) Date of Patent: Aug. 29, 2017

(54) MUSICAL INSTRUMENT SUPPORT DEVICE

(71) Applicant: Sangkuk Lee, Suwon-si (KR)

(72) Inventor: Sangkuk Lee, Suwon-si (KR)

( * ) Notice: Subject to any disclaimer, the term of this patent is extended or adjusted under 35 U.S.C. 154(b) by 0 days.

(21) Appl. No.: 15/314,941

(22) PCT Filed: Dec. 21, 2015

(86) PCT No.: PCT/KR2015/014000
§ 371 (c)(1),
(2) Date: Nov. 30, 2016

(87) PCT Pub. No.: WO2016/105041
PCT Pub. Date: Jun. 30, 2016

(65) Prior Publication Data

US 2017/0200437 A1 Jul. 13, 2017

(30) Foreign Application Priority Data

Dec. 22, 2014 (KR) ..... 20-2014-0009467 U

(51) Int. Cl.
*G10G 5/00* (2006.01)

(52) U.S. Cl.
CPC ..... *G10G 5/005* (2013.01)

(58) Field of Classification Search
CPC ..... G10G 5/005
See application file for complete search history.

(56) References Cited

U.S. PATENT DOCUMENTS 2,100,088 A * 11/1937 Robertson ..... G10G 5/005 2/331
2,247,867 A * 7/1941 Baumann ..... G10G 5/005 224/258
2,273,136 A * 2/1942 Orech ..... F16G 11/14 224/258
2,284,069 A * 5/1942 Robertson ..... G10G 5/005 224/258
2,561,606 A * 7/1951 Bates ..... G10G 5/005 224/258
2,630,255 A * 3/1953 Finder ..... G10G 5/005 224/258
3,129,863 A * 4/1964 Haugen ..... G10G 5/005 224/258
3,554,194 A * 1/1971 Johnson ..... A61F 5/3738 602/4
4,802,613 A * 2/1989 Tierney ..... A45F 5/00 224/606

(Continued)

FOREIGN PATENT DOCUMENTS

KR 481144 Y1 * 8/2016

*Primary Examiner* — Robert W Horn
(74) *Attorney, Agent, or Firm* — KORUS Patent, LLC; Seong Il Jeong

(57) ABSTRACT

There is provided a musical instrument support device comprising: first and second elongate pads spaced from each other, where each of the first and second elongate pads include an inner portion and an outer portion surrounding the inner portion; front strings coupled to front ends of the first and second elongate pads respectively; rear strings coupled to rear ends of first and second elongate pads and respectively; and a musical instrument connector coupled to the front strings wherein the musical instrument connector is configured to be removably coupled to the musical instrument.

5 Claims, 10 Drawing Sheets

(56) References Cited

U.S. PATENT DOCUMENTS

| | | | | | |
|---|---|---|---|---|---|
| 5,065,919 | A * | 11/1991 | Sims | A45F 5/00 | 224/257 |
| 5,215,239 | A * | 6/1993 | Walters, Jr. | A45F 5/00 | 224/259 |
| 5,753,839 | A * | 5/1998 | McFarlin | G10G 5/005 | 84/258 |
| 5,772,091 | A * | 6/1998 | Lackner | G10G 5/005 | 224/265 |
| 6,648,197 | B2 * | 11/2003 | Perry | A45F 5/00 | 224/251 |
| 7,282,631 | B2 * | 10/2007 | Chou | G10G 5/005 | 84/385 A |
| 7,655,853 | B1 * | 2/2010 | Ricca | G10G 5/005 | 84/385 A |
| 8,940,987 | B2 * | 1/2015 | Kaynor | G10D 7/123 | 84/379 |
| 9,029,673 | B2 * | 5/2015 | Kaynor | G10G 5/00 | 84/379 |
| 9,038,872 | B1 * | 5/2015 | Chang | A45F 5/00 | 224/257 |
| 9,524,705 | B2 * | 12/2016 | Pittel | G10G 5/005 | |
| 9,659,551 | B1 * | 5/2017 | Rubin | G10G 5/005 | |
| 2013/0263718 | A1 * | 10/2013 | Jancic | G10G 5/005 | 84/387 A |

* cited by examiner

MUSICAL INSTRUMENT SUPPORT DEVICE

BACKGROUND

Field of the Present Disclosure

The present disclosure relates to a musical instrument support device, and, more particularly, to a musical instrument support device to spread the weight of the musical instrument over the shoulder and back of the player.

Discussion of Related Art

Typically, a saxophone is a tube musical instrument that uses a single reed-containing tongue. The body thereof is usually made of brass. The player's finger presses the finger keys formed on the front of the body to create high and low tones. In addition, at the tip of the body, the saxophone includes a mouthpiece including a reed and a fastener. The player bites the reed and injects air therethrough into the body.

To play the saxophone, the user uses a separate strap to carry the saxophone. For example, a saxophone neck strap is used to hook the saxophone using a loop to support the player's neck.

However, these saxophone neck straps cause the throat of the player to bear the heavy load of the saxophone. Thus, this may cause strong pressure on the neck during playing, thereby to cause the pain in the neck and, in severe cases, to cause problems such as neck discs.

PRIOR ART

Patent Document

Korean Utility Model registration No. 20-0469459 (2013 Oct. 17)

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

The present disclosure is to provide a musical instrument support device to allow the player to easily carry the musical instrument.

The present disclosure is to provide a musical instrument support device to prevent the weight of the musical instrument from being concentrated on the portion of the body of the player, and, thereby, to allow the player to play the musical instrument in a comfortable manner.

The advantages and objects of the present disclosure are not limited thereto.

In one aspect of the present disclosure, there is provided a musical instrument support device comprising: first and second elongate pads spaced from each other, where each of the first and second elongate pads include an inner portion and an outer portion surrounding the inner portion; front strings coupled to front ends of the first and second elongate pads respectively; rear strings coupled to rear ends of first and second elongate pads and respectively; and a musical instrument connector coupled to the front strings wherein the musical instrument connector is configured to be removably coupled to the musical instrument.

In one implementation, each of the first and second elongate pads is rounded at the front end and rear end thereof.

In one implementation, the first and second elongate pads further include first and second wings respectively, wherein the first and second wings face each other, wherein each of the first and second wings protrudes inwardly from the first and second elongate pads respectively in middle portions of the longitudinal direction thereof, wherein the first and second wings have first and second pluralities of second adjustment holes formed therein respectively, wherein the first and second elongate pads have first and second rear holes defined in read ends thereof respectively; wherein the rear strings pass through the first and second adjustment holes respectively and pass through the first and second rear holes respectively and are coupled to the first and second elongate pads at the rear ends thereof respectively.

In one implementation, the musical instrument support device further comprises a rear position adjustment unit having a rear fixing hole, first and second rear adjustment holes, and first and second rear support holes defined therein wherein the rear strings comprise a rear middle portion passing through the first and second rear adjustment holes and fixed to the rear position adjustment unit; a first rear string passing through the first adjustment hole, and the first rear support hole and the first rear adjustment hole, and the rear fixing hole, and the first rear hole in this order and being coupled to the first elongate pad at the rear end thereof; and a second rear string passing through the second adjustment hole, the second rear support hole, and the second rear adjustment hole, the rear fixing hole, and the second rear hole in this order and being coupled to the second elongate pad at the rear end thereof.

In one implementation, the first and second elongate pads have first and second front holes defined in the front ends thereof respectively, wherein the musical instrument support device further includes a front position adjustment unit having first and second front fixing holes, first and second front adjustment holes, and first and second front support holes defined therein, wherein the front strings includes: a front middle portion passing through the first and second front fixing holes and being fixed to the front position adjustment unit; a first front string passing through the first front hole, the first front support hole, the first front adjustment hole, and a loop of the musical instrument connector in this order and being coupled to the first elongate pad at the front end thereof; and a second front string passing through the second front hole, the second front support hole, the second front adjustment hole, and the loop of the musical instrument connector in this order and being coupled to the second elongate pad at the front end thereof.

In one implementation, the first and second elongate pads have first and second front holes defined in the front ends thereof respectively, wherein the musical instrument support device further includes: a front position adjustment unit having first and second front fixing holes, first and second front adjustment holes, and first and second front support holes defined therein; an auxiliary position adjustment unit having first and second front auxiliary holes and first and second rear auxiliary holes defined therein; and auxiliary strings to connect the front strings and the rear strings respectively, wherein the front strings includes: a front middle portion passing through the first and second front fixing holes and being fixed to the front position adjustment unit; a first front string passing through the first front hole, the first front support hole, the first front adjustment hole, and a loop of the musical instrument connector in this order and being coupled to the first elongate pad at the front end thereof; and a second front string passing through the second front hole, the second front support hole, the second front adjustment hole, and the loop of the musical instrument connector in this order and being coupled to the second elongate pad at the front end thereof, wherein the auxiliary strings comprises: a first auxiliary string passing through the first front auxiliary hole and the first rear auxiliary hole and connecting the first rear string and the first front string; and a second auxiliary string passing through the second front auxiliary hole and the second rear auxiliary hole and connecting the second rear string and the second front string.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

DETAILED DESCRIPTIONS

Figure 1:
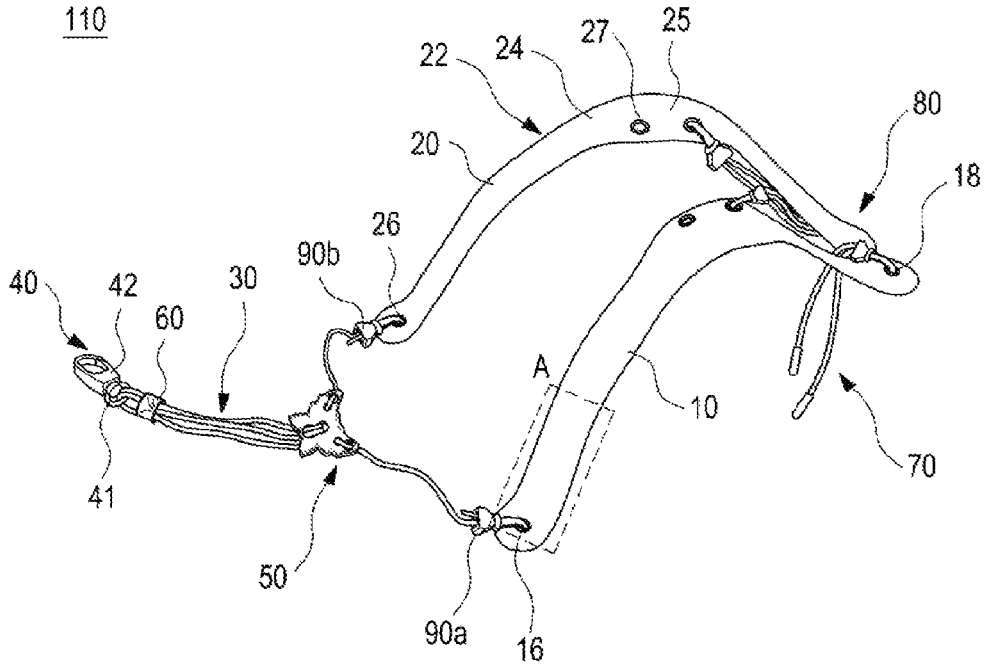
FIG. 1 is a perspective view of a musical instrument support device in accordance with one embodiment.

For simplicity and clarity of illustration, elements in the figures are not necessarily drawn to scale. The same reference numbers in different figures denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present disclosure refers to "one or more embodiments of the present disclosure."

Figure 2:
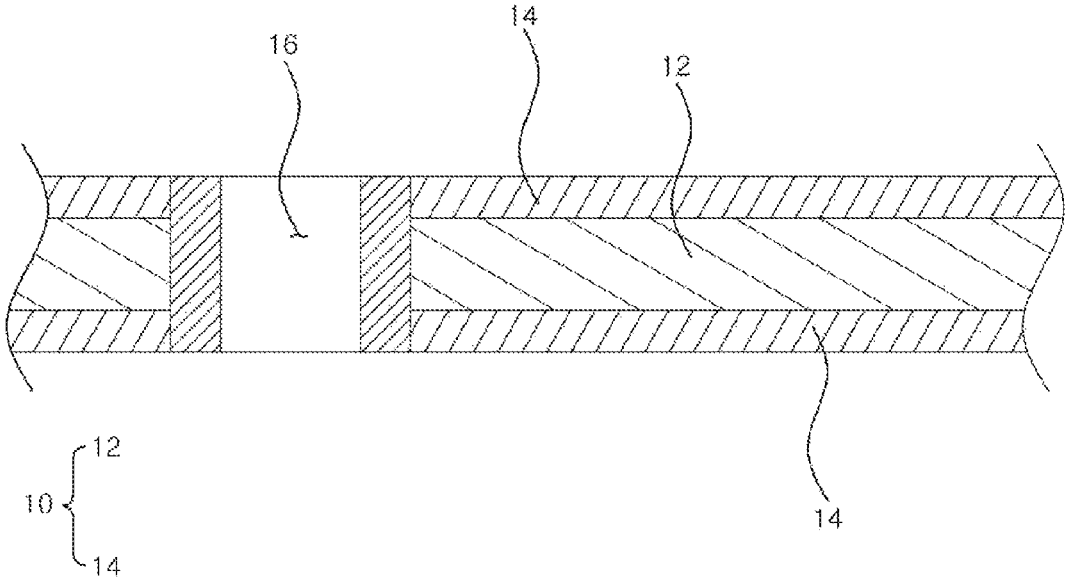
FIG. 2 is a cross-sectional view of a portion "A" in FIG. 1.
Figure 3:
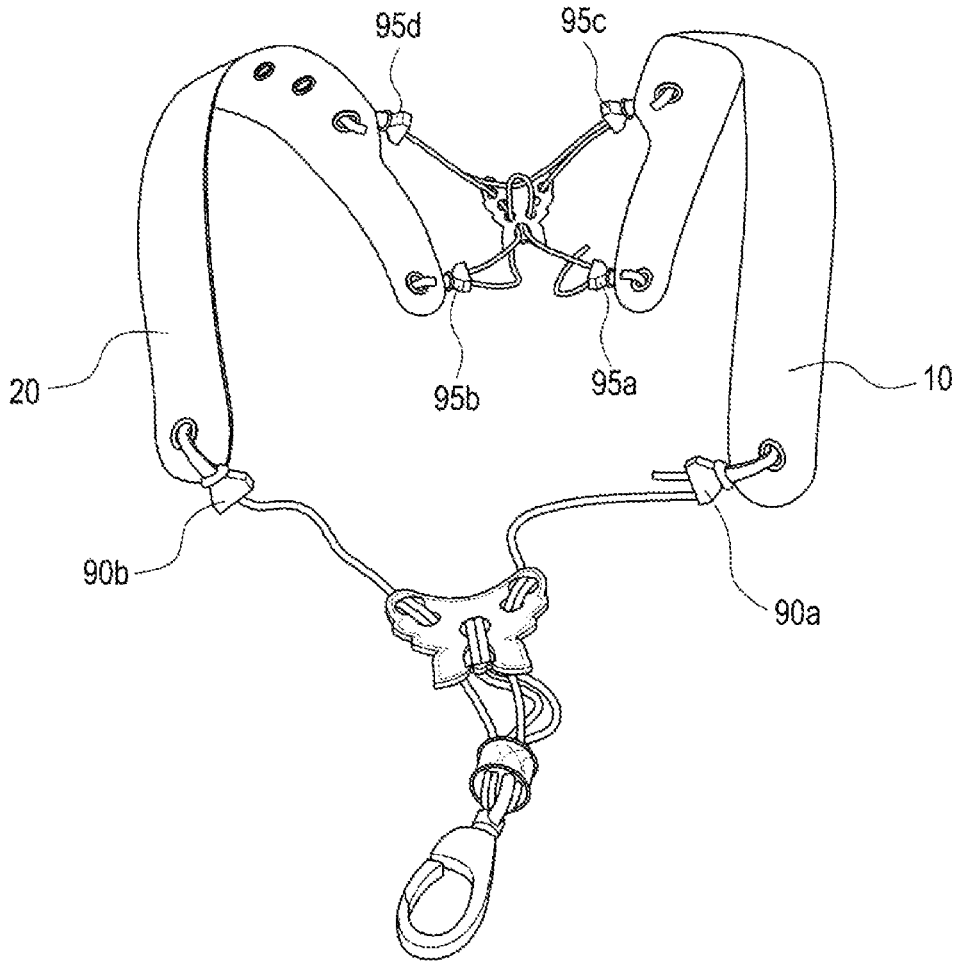
FIG. 3 is a front view of FIG. 1.
Figure 4:
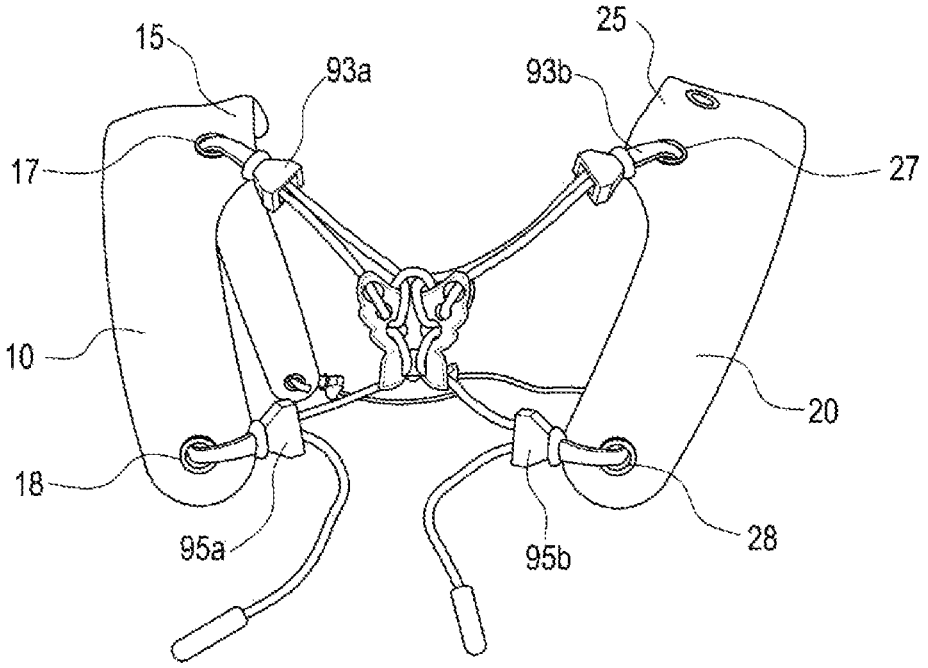
FIG. 4 is a rear view of FIG. 3.
Figure 5:
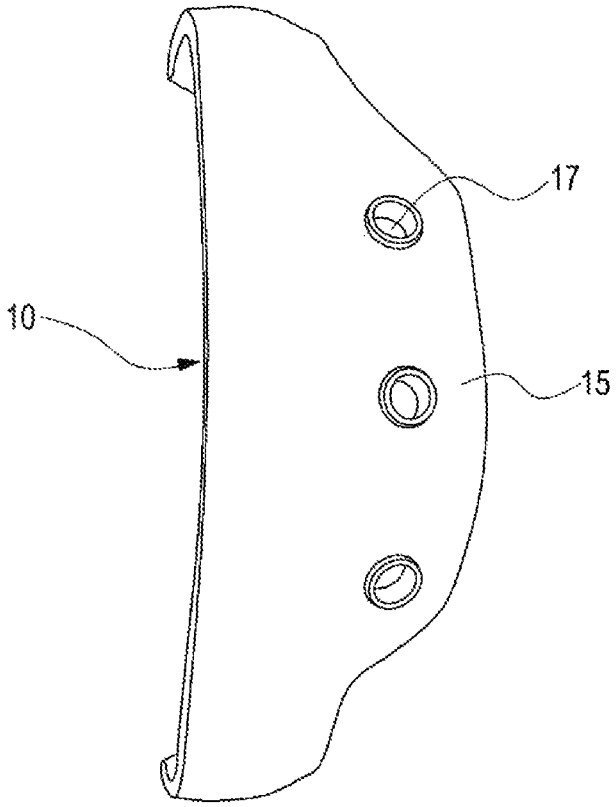
FIG. 5 is an enlarged view of a wing in FIG. 1.

FIG. 1 is a perspective view of a musical instrument support device in accordance with one embodiment. FIG. 2 is a cross-sectional view of a portion "A" in FIG. 1. FIG. 3 is a front view of FIG. 1. FIG. 4 is a rear view of FIG. 3. FIG. 5 is an enlarged view of a wing in FIG. 1. As shown in FIG. 1 to FIG. 5, a musical instrument support device 100 may include first and second elongate pads 10 and 20, front strings 30 coupled to front ends of the first and second elongate pads 10 and 20 respectively, rear strings 70 coupled to rear ends of first and second elongate pads 10 and 20 respectively, and a musical instrument connector 40 coupled to the front strings 30 wherein the musical instrument connector 40 is configured to be removably coupled to the musical instrument.

First and second elongate pads 10 and 20 are placed on the player's left shoulder and right shoulder respectively. Thus, the weight of the musical instrument is transmitted to the player's shoulders and back through the first and second elongate pads 10 and 20, as described below. In addition, each of the first and second elongate pads 10 and 20 has a certain width in the direction of the shoulder width of the player. The weight of the musical instrument is distributed evenly on the contact faces of the first and second elongate pads 10 and 20. Thus, the actual weight of the musical instrument supported by the player may be alleviated.

Hereinafter, for convenience of explanation, the first elongate pad 10 is mainly described. The second elongate pad 20 has the shape and structure corresponding to those of the first elongate pad 10. Further, the differences therebetween will be described separately.

The first elongate pad 10 comprises a first inner portion 12 made of a metal and a first outer portion 14 surrounding the first inner portion 12. For example, the first inner portion 12 may be made of lightweight and durable aluminum. When the player wears the musical instrument support device 100, the rear end of the first inner portion 12 is located on the scapula and the front end of the first inner portion 12 is placed on the clavicle.

The first inner portion 12 is made of a relatively softer aluminum material so that the portion 12 can bend annularly to wrap around the player's shoulder. Thus, the first inner portion 12 may be flexibly adapted to the shape of the player's body.

The first outer portion 14 is made of a flexible material such as natural or artificial leather, cloth, synthetic resin, etc. Thus, first outer portion 14 can be in close contact with the player's shoulder. Between the first outer portion 14 and the first inner portion 12, a cushion member such as a cotton may be interposed to impose the soft wearing feel on the player.

The first elongate pad 10 has a first front hole 16 defined through a thickness of the first elongate pad 10 at a front end thereof, and a first rear hole 18 defined through a thickness of the first elongate pad 10 at a rear end thereof. Thus, each of the first front hole 16 and the first rear hole 18 penetrates the first outer portion 14 and the first inner portion 12. Therefore, the musical instrument is easily supported by the first inner portion 12 even if the load of the relatively heavy musical instrument mainly made of brass is concentrated on the front and rear ends of the first elongate pad 10 and, thus, the first outer portion 14 is damaged.

The first outer portion 14 may further include a first wing 15 protruding inwardly therefrom in a middle portion thereof. The first wing 15 may have a plurality of first adjustment holes 17 formed through a thickness of the first wing 15. The plurality of first adjustment holes 17 may be arranged to be spaced apart from each other at a predetermined distance along the longitudinal direction of the first elongate pad 10.

Likewise, the second outer portion 24 may further include a second wing 25 protruding inwardly therefrom in a middle portion thereof. The second wing 25 may have a plurality of second adjustment holes 27 formed through a thickness of the second wing 25. The plurality of second adjustment holes 27 may be arranged to be spaced apart from each other at a predetermined distance along the longitudinal direction of the second elongate pad 20

Each of the front end and the rear end of the first outer portion 14 may have a rounded shape. This may facilitate smooth movement of first and second front loops 90*a* and 90*b* movably connected to the front ends of the first and second elongate pads 10 and 20 respectively, and smooth movement of first and second rear loops 95*a* and 95*b* movably connected to the rear ends of the first and second elongate pads 10 and 20 respectively, as described below. In addition, the front and rear ends of each of the first and second wings 15 and 25 are rounded so that first and second adjustment loops 93*a* and 93*b* as described below can have easy movement.

Figure 6:
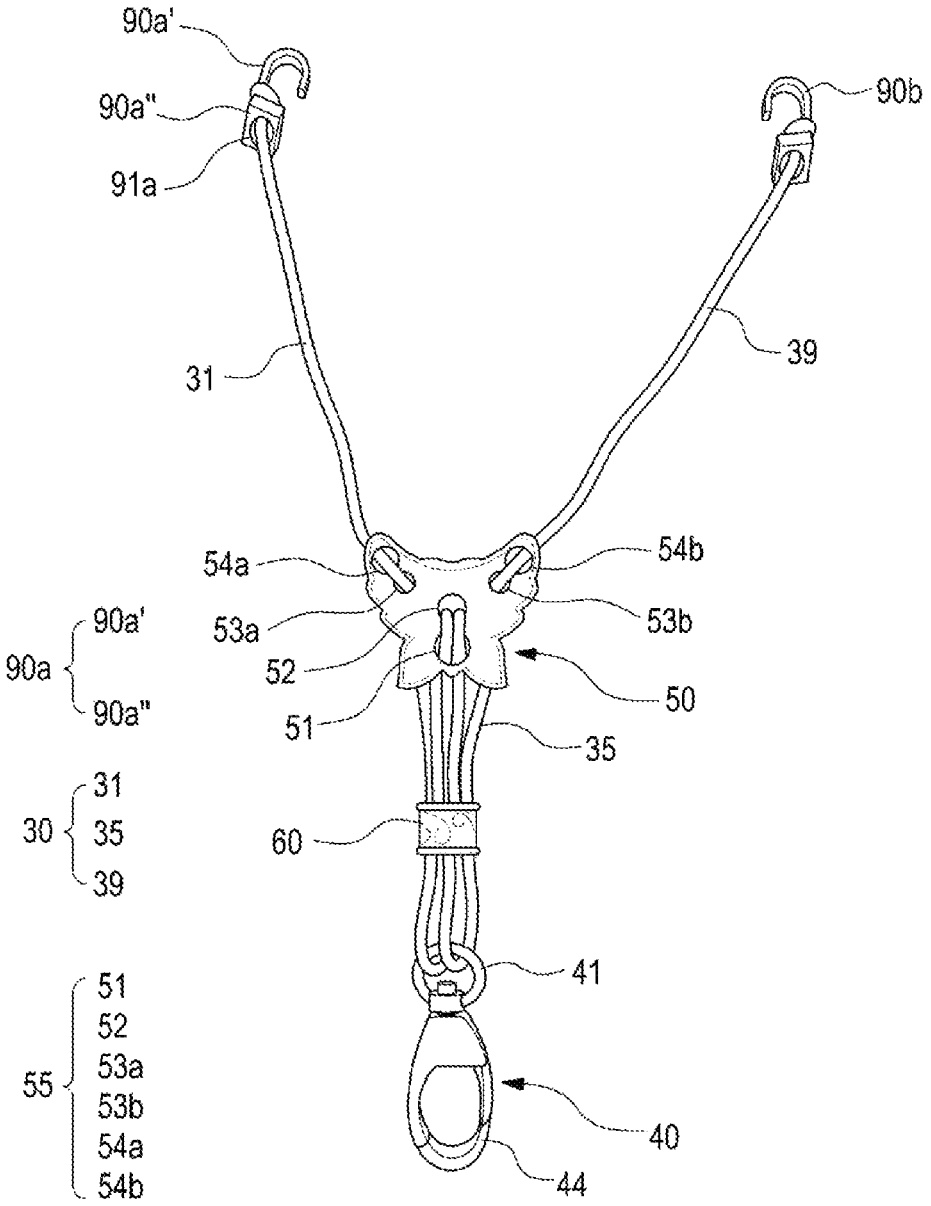
FIG. 6 is an enlarged view of front strings in FIG. 3.
Figure 7:
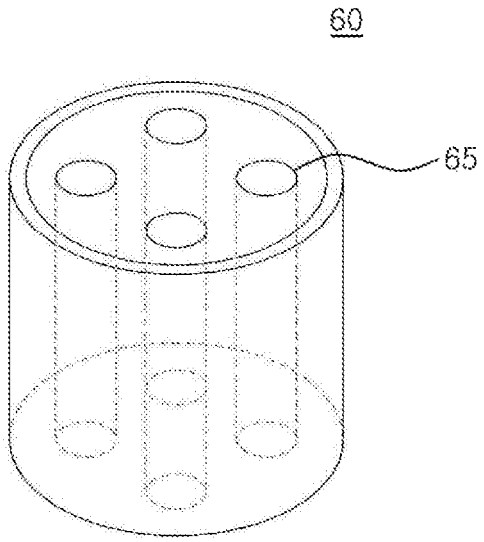
FIG. 7 is perspective view of an entanglement-prevention unit in FIG. 6.

FIG. 6 is an enlarged view of front strings in FIG. 3. FIG. 7 is perspective view of an entanglement-prevention unit in FIG. 6. As shown in FIG. 6 and FIG. 7, the musical instrument support device 100 may include a musical instrument connector 40 coupled removably to the musical instrument. A front position adjustment unit 50 may have first and second front fixing holes 51 and 52 at a lower portion thereof, first and second front adjustment holes 53*a* and 53*b* above the fixing holes 51 and 52, and first and second front support holes 54*a* and 54*b* above the front adjustment holes 53*a* and 53*b*. The plurality of the holes may be defined through the thickness of the front position adjustment unit 50.

The entanglement-prevention unit 60 may be located between the front position adjustment unit 50 and musical instrument connector 40. The entanglement-prevention unit 60 may have plurality of holes 65 defined therein, through which the front strings 30 pass. The first and second front strings 31 and 39 may pass upwards and downwards through the holes 65. Thus, the entanglement-prevention unit 60 may suppress entanglement of the first and second strings 31 and 39.

The front strings 30 may include first and second front strings 31 and 39 and a front middle portion 35 coupled to and between the first and second front strings 31 and 39. The front middle portion 35 may be fixed to the first and second front fixing holes 51 and 52 via a knot. The first and second front strings 31 and 39 coupled to the front middle portion 35 may pass through a musical instrument connector loop 41 coupled to the musical instrument connector 40 to fix the musical instrument connector 40 to the front strings 30.

The first front string 31 may pass through the first front support hole 54*a* and first front adjustment hole 53*a* sequentially, and, then, pass through the entanglement-prevention unit 60 and musical instrument connector loop 41. Similarly, the second string 39 may pass through the second front support hole 54*b* and second front adjustment hole 53*b* sequentially, and, then, pass through the entanglement-prevention unit 60 and musical instrument connector loop 41. The middle portion 35 coupled to the first front string 31 and second front string 39 may be fixed to the first and second front fixing holes 51 and 52 via a knot.

In this way, the first and second front strings 31 and 39 may overlap horizontally. The level of the musical instrument connector 40 may be determined based on the overlapping length of the first and second front strings 31 and 39. That is, as the front position adjustment unit 50 moves along the first and second front strings 31 and 39, the overlapping length of the first and second front strings 31 and 39 may vary. When the overlapping length of the first and second front strings 31 and 39 increases, the musical instrument connector 40 may be closer to the first and second elongate pads 10 and 20. When the overlapping length of the first and second front strings 31 and 39 decreases, the musical instrument connector 40 may go far away from the first and second elongate pads 10 and 20.

The musical instrument can be coupled to the musical instrument connector 40 by opening and closing the openable portion 44. The player can adjust the position of the musical instrument connector 40 using the front position adjustment unit 50. That is, as the front position adjustment unit 50 moves along the first and second front strings 31 and 39, the overlapping length of the first and second front strings 31 and 39 increases or decreases. In this way, the height of the musical instrument connector 40 or the height of the musical instrument may be adjusted.

When the musical instrument is coupled to the musical instrument connector 40, the weight of the musical instrument is transmitted to the first and second elongate pads 10 and 20 via the first and second front strings 31 and 39. Thus, the weight of the musical instrument may be prevented from being concentrated on a portion of the body of the player.

The first front string 31 may be fixed to the first front loop 90*a*, and the second front string 39 may be fixed to the second front loop 90*b*. The first and second front loops 90*a* and 90*b* may have the same shape. For example, the first front loop 90*a* may have a first upper front loop 90*a*' inserted into and fixed to the first front hole 16 and a first lower front loop 90*a*" coupled to the first upper front loop 90*a*' at the bottom thereof. The first lower front loop 90*a*" may have a support hole 91*a* defined in a length direction thereof. The first front string 31 may pass through the support hole 91*a* and then the first front loop 90*a* may be coupled to the first front string 31. The first upper front loop 90*a*' may have a hook shape or a clipper shape.

The first lower front loop 90*a*" may have an outer diameter that that of the first upper front loop 90*a*'. The first front string 31 may pass through the support hole 91*a* in the first lower front loop 90*a*" and may be supported by the top of the first lower front loop 90*a*". Then, the first front string 31 may back pass through the support hole 91*a* and then pass through the holes in the front position adjustment unit 50.

The second front loop 90*b* may have a similar structure to the first front loop 90*a*. The second string 39 may be coupled to the second front loop 90*b* in the same way such that the first front string 31 is coupled to the first front loop 90*a*. The second front loop 90*b* may pass through the second front hole 26 defined in the second elongate pad 20 and then be fixed to the elongate pad 20. The musical instrument coupled to the musical instrument connector 40 is coupled to the first and second elongate pads 10 and 20 via the first and second front loops 90*a*, 90*b*. Thus, the weight of the musical instrument may be distributed on the shoulder and back of the player.

Figure 8:
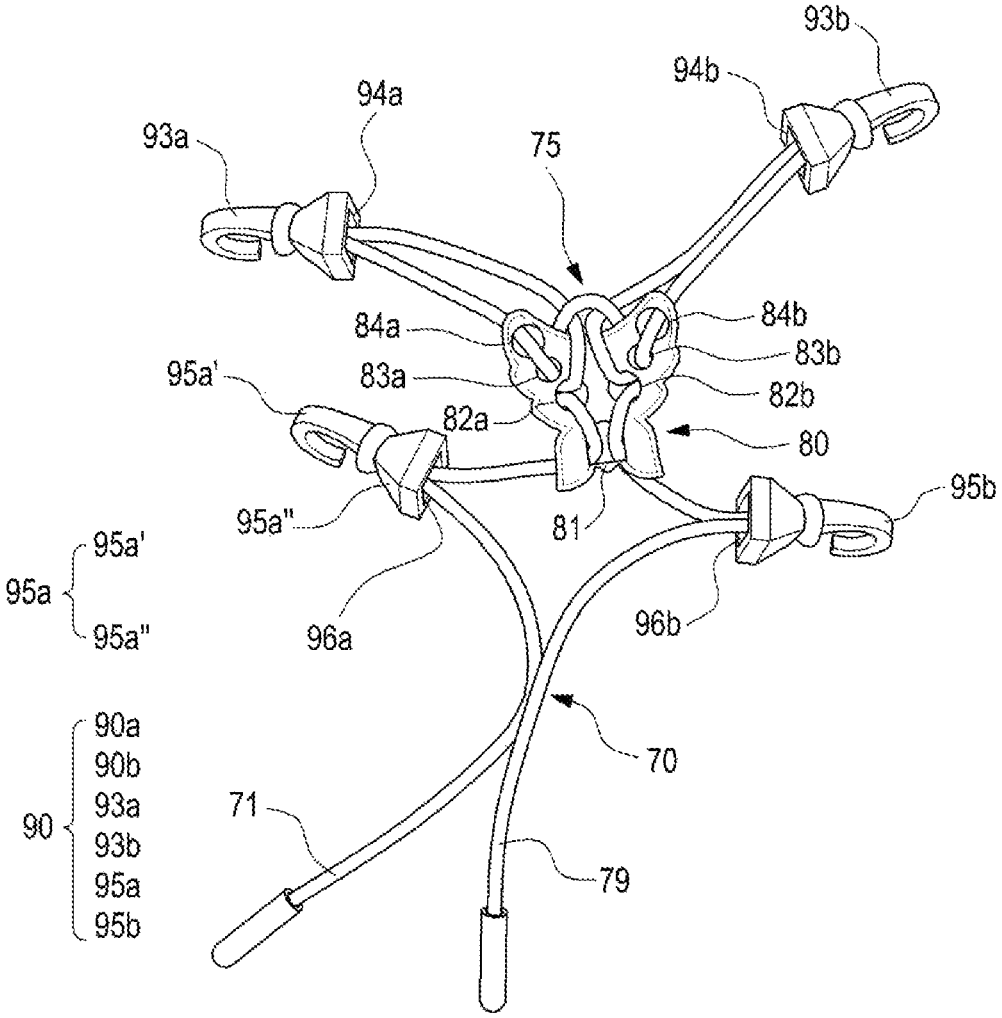
FIG. 8 is an enlarged view of rear strings in FIG. 4.

FIG. 8 is an enlarged view of rear strings in FIG. 4. As shown in FIG. 8, the rear string 70 may include first and second rear strings 71, 79 and a rear middle portion 75 coupled to and between the first and second rear strings 71, 79. The rear position adjustment unit 80 may have a rear fixing hole 81, first and second rear adjustment holes 82*a*, 82*b*, and first and second rear support holes 84*a*, 84*b* defined therein.

The first rear string 71 may be fixed to the first elongate pad 10 via the first rear main loop 95*a* and first rear adjustment loop 93*a*. The second rear string 79 may be fixed to the second elongate pad 20 via the second rear main loop 95*b* and second rear adjustment loop 93*b*.

Each of the loops 90 may have the same configuration as that of the first front loop 90*a* as described above. For example, the first rear main loop 95*a* may have a first upper rear main loop 95*a*' passing through the first rear hole 18 and fixed to the first rear end of the pad, and a first lower rear main loop 95*a*" coupled to the first upper rear main loop 95*a*' at the bottom thereof. The first lower rear main loop 95*a*" may have a support hole 96*a* defined in a length direction of thereof. The first rear string 71 may pass through the support hole 96*a* and may be coupled to the first rear main loop 95*a*.

The first rear string 71 may pass through the support hole 96*a* defined in the first rear main loop 95*a* and may pass through the rear fixing hole 81 and first rear adjustment hole 82*a* and first rear support hole 84*a*, sequentially and then pass through the support hole 94*a* defined in the first rear adjustment loop 93*a*. The second rear string 79 may pass through the support hole 96*b* defined in the second rear main loop 95*b* and may pass through the rear fixing hole 81 and second rear adjustment hole 82*b* and second rear support hole 84*b*, and then the support hole 94*b* defined in the second rear adjustment loop 93*b* in this order.

The rear middle portion 75 coupled to the first rear string 71 and second rear string 79 may pass through the first rear adjustment hole 82*a* and second rear adjustment hole 82*b* and then may fixed to the rear position adjustment unit 80 at the rear end thereof via a knot.

The rear position adjustment unit 80 may include a first rear connection hole 83*a* formed between the first rear adjustment hole 82*a* and first rear support hole 84*a*, and a second rear connection hole 83*b* formed between the second rear adjustment hole 82*b* and second rear support hole 84*b*.

The first rear string 71 may pass through the first rear adjustment hole 82*a* and then the first rear connection holes 83*a* and then the first rear support hole 84*a*. The second rear string 79 may pass through the second rear adjustment hole 82*b*, the second rear connection hole 83*b* and the second rear support hole 84*b* in this order. Each of the first and second rear strings 71 and 79 may pass through the holes upwards and downwards.

Figure 9:
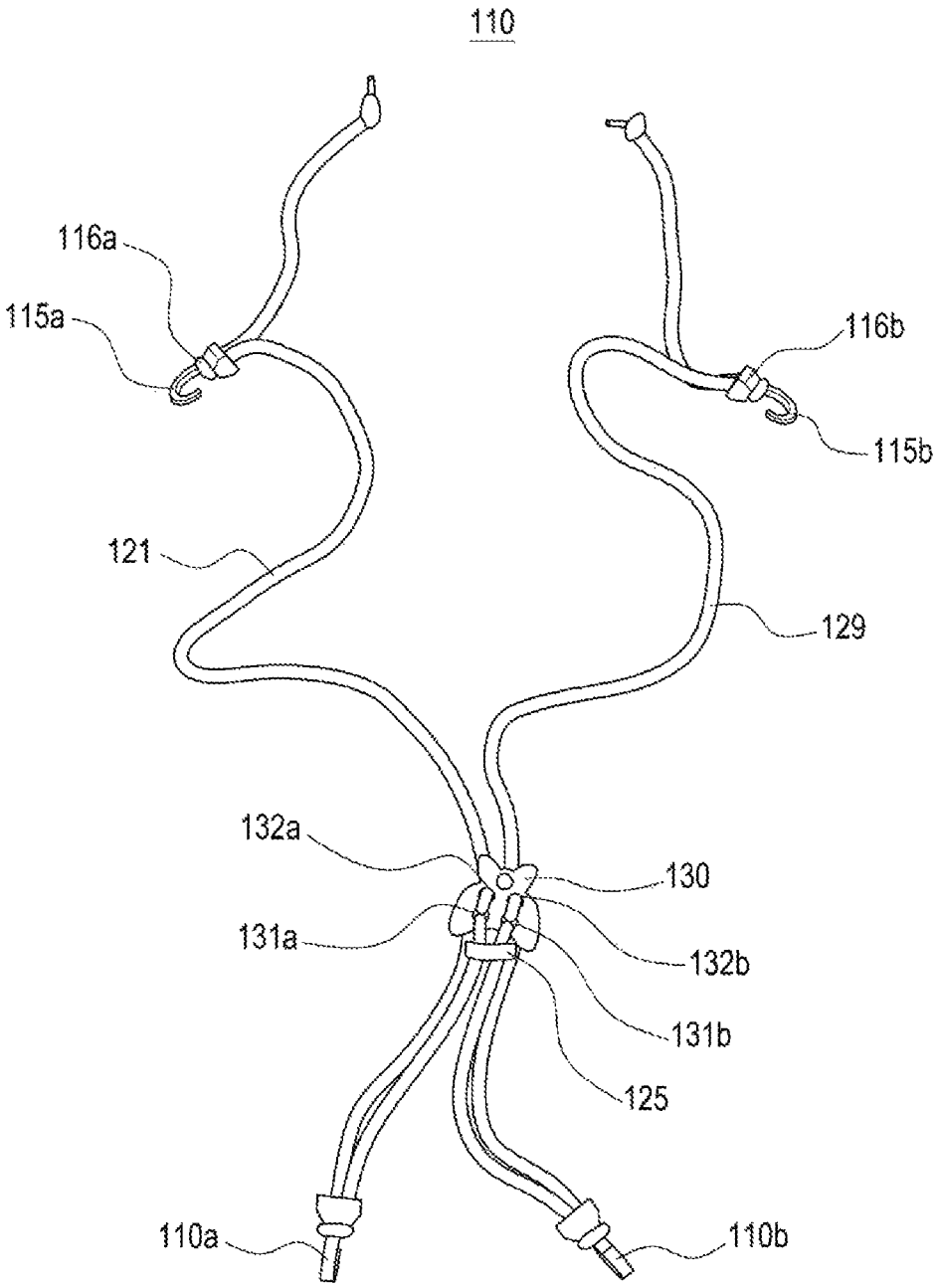
FIG. 9 is a view of auxiliary strings coupled to the musical instrument support device in FIG. 1.

FIG. 9 is a view of auxiliary strings coupled to the musical instrument support device in FIG. 1. As shown in FIG. 9, the auxiliary strings 120 may be coupled to the auxiliary position adjustment unit 130 substantially in the same way as that in the second rear string 70. The auxiliary string 120 may include first and second auxiliary strings 121 and 129 and an auxiliary middle portion 125 coupled to and between the first and second auxiliary strings 121 and 129.

The auxiliary position adjustment unit 130 may have first and second front auxiliary holes 132*a*, 132*b* and first and second rear auxiliary holes 131*a*, 131*b* defined therein. The first auxiliary string 121 may pass through a support hole 116*a* defined in the first front auxiliary loop 115*a* and may be fixed to the first front auxiliary loop 115*a*. Further, the first auxiliary string 121 may pass through the first front auxiliary holes 132*a* and first rear auxiliary hole 131*a* defined in the auxiliary position adjustment unit 130 sequentially and may pass through a support hole 111*a* defined in the first rear auxiliary loop 110*a*.

The second auxiliary string 129 may be inserted into the support hole 116*b* formed in the second front auxiliary loop 115*b* and may be fixed to the second front auxiliary loop 115*b*. Also, the second auxiliary string 129 may be inserted into the second front auxiliary hole 132*b* and second rear auxiliary hole 131*b* formed in the auxiliary position adjustment unit 130 sequentially, and may be inserted into a support hole 111*b* formed in the second rear auxiliary loop 110*b*.

The auxiliary middle portion 125 is connected to the first auxiliary string 121 and the auxiliary string 129 and passes through the first auxiliary hole 131*a* and the second rear auxiliary holes 131*b* and is fixed to the auxiliary position adjustment unit 130 at a rear end thereof via a knot.

Figure 10:
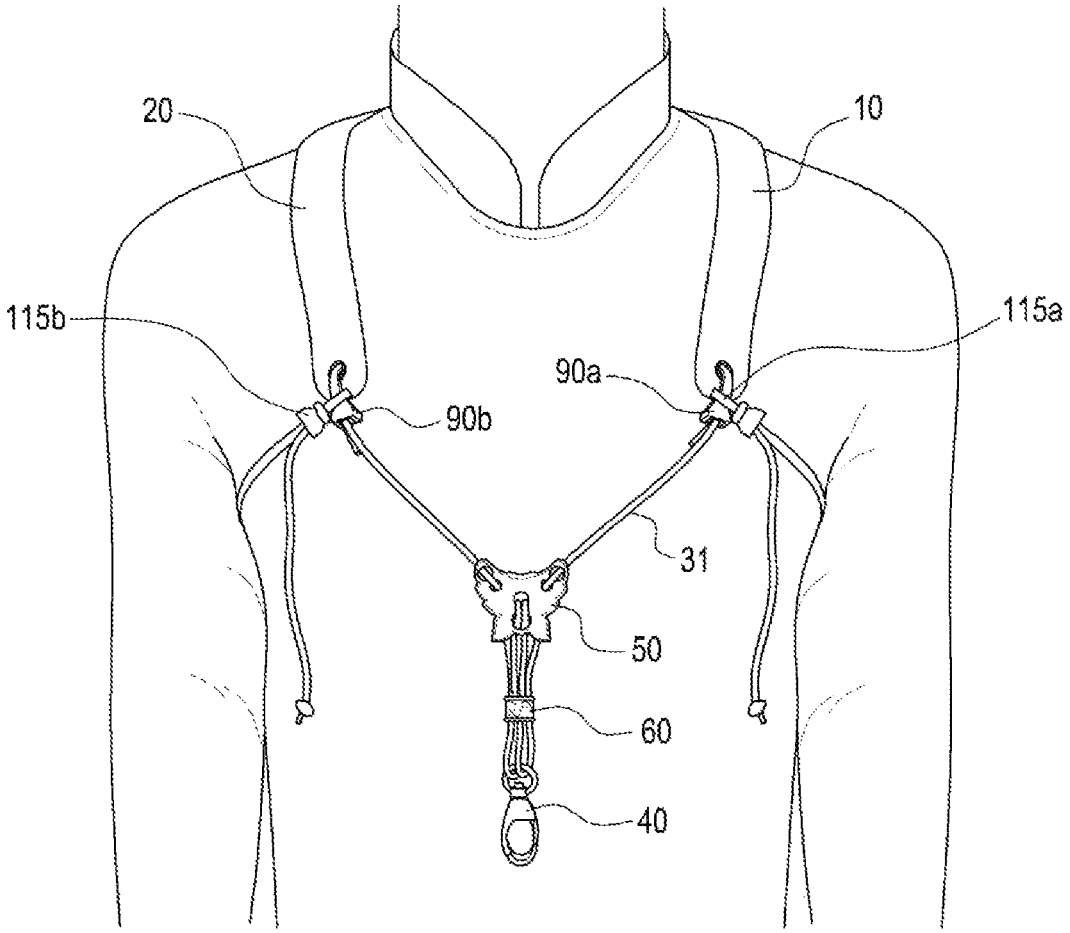
FIG. 10 and FIG. 11 illustrate front and rear states when the present musical instrument support device is worn on the body of the player.
Figure 11:
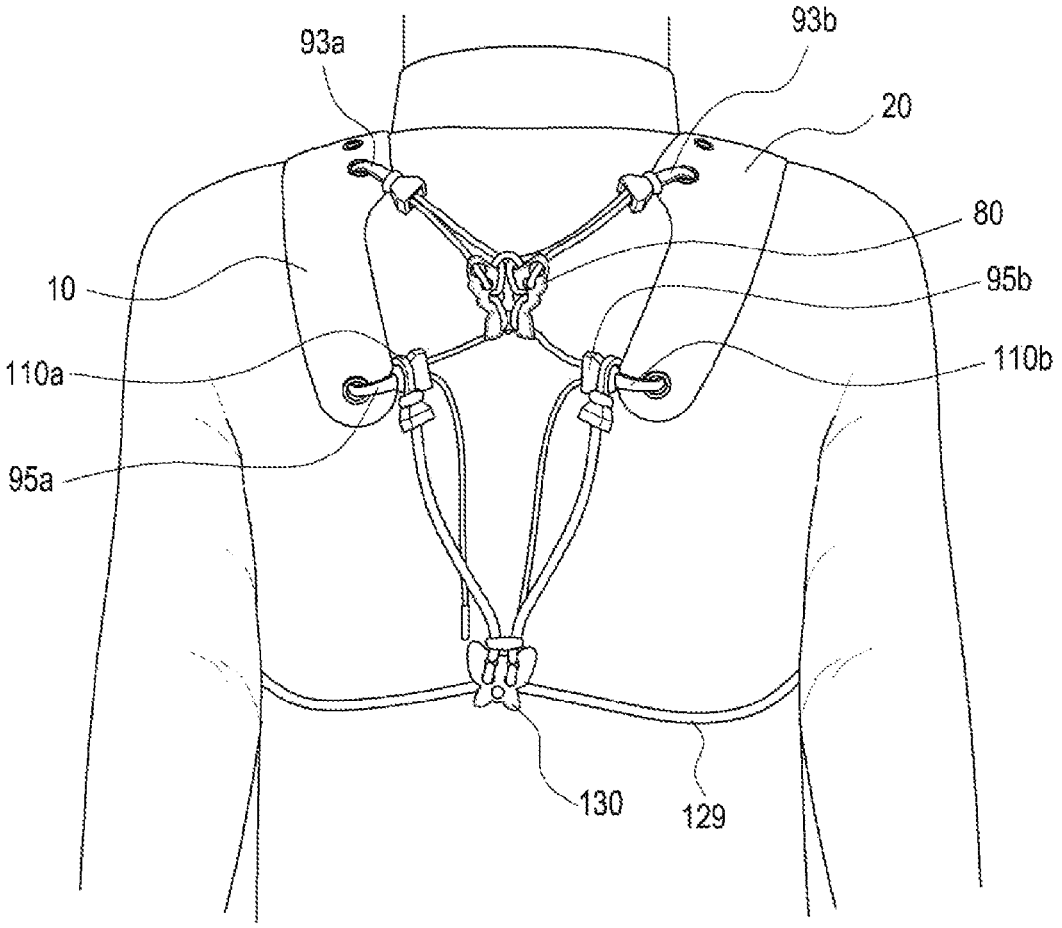

FIG. 10 and FIG. 11 illustrate front and rear states when the present musical instrument support device is worn on the body of the player. As for the musical instrument support device as shown in FIG. 10 and FIG. 11, the front string 30 and rear string 70 are connected to the front and rear ends of the first and second elongate pads 10 and 20 respectively. When the player wears the musical instrument support device 100, the first and second elongate pads 10 and 20 are placed, at the rear ends thereof, on the scapula, and the first and second elongate pads 10 and 20 are placed, at the front ends thereof, on the clavicle.

As described above, the first and second elongate pads 10 and 20 may be configured such that the first and second inner portions 12 and 22 thereof may be bent annularly around the shoulder and back of the player. The first and second elongate pads 10 and 20 may be freely adapted to the shape of the body of the player.

When the player is playing a musical instrument, it may be preferable the movement of the musical instrument or rapid movement of the player may be available. To this end, the front string 30 may have a smooth outer surface. The outer smooth surface of the front string 30 may minimize the frictional force with the front position adjustment unit 50. Thus, the front position adjustment unit 50 is movable along the front string 30 using a smaller force. Therefore, the player may have more natural performance and may not be restricted in activity thereof.

On the other hand, it is preferable to use a chain type or knot type rear string 70 such that the outer surface thereof is rougher than the outer surface of the front string 30. By adjusting the length of the rear string 70 to be adapted to the player's body, it is possible to prevent the rear position adjustment unit 80 from moving along the rear string 70 due to the movement of the player. Of course, when the first and second elongate pads 10 and 20 are pulled in opposite directions with a strong force, the rear position adjustment unit 80 may be moved along the rear string 70.

The first and second rear auxiliary loops 110*a* and 110*b* may be fixed to the first and second rear main loops 95*a* and 95*b* respectively. The first and second front auxiliary loops 115*a* and 115*b* may be fixed to the first and second front loops 90*a* and 90*b* respectively. In other words, while the first and second rear auxiliary loops 110*a* and 110*b* are fixed to the first and second rear main loops 95*a* and 95*b* respectively, the first front auxiliary loop 115*a* passes through the left armpit of the player and then is fixed to the first front loop 90*a*, and the auxiliary loop 115*b* passes through the right armpit of the player and then is fixed to the second front loop 90*b*. In this way, the first and second elongate pads 10 and 20 can be prevented from leaning toward the center of the chest during the long playing process. On the other hand, the first and second front auxiliary loops 115*a* and 115*b* may be fastened to the belts or belts of the player.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A musical instrument support device comprising:

first and second elongate pads spaced from each other, where each of the first and second elongate pads include an inner portion and an outer portion surrounding the inner portion;

front strings coupled to front ends of the first and second elongate pads respectively;

rear strings coupled to rear ends of first and second elongate pads and respectively; and a musical instrument connector coupled to the front strings wherein the musical instrument connector is configured to be removably coupled to the musical instrument, wherein the first and second elongate pads further include first and second wings respectively, wherein the first and second wings face each other, wherein each of the first and second wings protrudes inwardly from the first and second elongate pads respectively in middle portions of the longitudinal direction thereof, wherein the first and second wings have first and second pluralities of second adjustment holes formed therein respectively, wherein the first and second elongate pads have first and second rear holes defined in read ends thereof respectively;

wherein the rear strings pass through the first and second adjustment holes respectively and pass through the first and second rear holes respectively and are coupled to the first and second elongate pads at the rear ends thereof respectively.

2. The musical instrument support device of claim 1, wherein each of the first and second elongate pads is rounded at the front end and rear end thereof.

3. The musical instrument support device of claim 1, further comprising:

a rear position adjustment unit having a rear fixing hole, first and second rear adjustment holes, and first and second rear support holes defined therein wherein the rear strings comprise:

a rear middle portion passing through the first and second rear adjustment holes and fixed to the rear position adjustment unit;

a first rear string passing through the first adjustment hole, and the first rear support hole and the first rear adjustment hole, and the rear fixing hole, and the first rear hole in this order and being coupled to the first elongate pad at the rear end thereof; and a second rear string passing through the second adjustment hole, the second rear support hole, and the second rear adjustment hole, the rear fixing hole, and the second rear hole in this order and being coupled to the second elongate pad at the rear end thereof.

4. The musical instrument support device of claim 1, wherein the first and second elongate pads have first and second front holes defined in the front ends thereof respectively, wherein the musical instrument support device further includes a front position adjustment unit having first and second front fixing holes, first and second front adjustment holes, and first and second front support holes defined therein, wherein the front strings includes:

a front middle portion passing through the first and second front fixing holes and being fixed to the front position adjustment unit;

a first front string passing through the first front hole, the first front support hole, the first front adjustment hole, and a loop of the musical instrument connector in this order and being coupled to the first elongate pad at the front end thereof; and a second front string passing through the second front hole, the second front support hole, the second front adjustment hole, and the loop of the musical instrument connector in this order and being coupled to the second elongate pad at the front end thereof.

5. The musical instrument support device of claim 3, wherein the first and second elongate pads have first and second front holes defined in the front ends thereof respectively, wherein the musical instrument support device further includes:

a front position adjustment unit having first and second front fixing holes, first and second front adjustment holes, and first and second front support holes defined therein;

an auxiliary position adjustment unit having first and second front auxiliary holes and first and second rear auxiliary holes defined therein; and auxiliary strings to connect the front strings and the rear strings respectively, wherein the front strings includes:

a front middle portion passing through the first and second front fixing holes and being fixed to the front position adjustment unit;

a first front string passing through the first front hole, the first front support hole, the first front adjustment hole, and a loop of the musical instrument connector in this order and being coupled to the first elongate pad at the front end thereof; and a second front string passing through the second front hole, the second front support hole, the second front adjustment hole, and the loop of the musical instrument connector in this order and being coupled to the second elongate pad at the front end thereof, wherein the auxiliary strings comprises:

a first auxiliary string passing through the first front auxiliary hole and the first rear auxiliary hole and connecting the first rear string and the first front string; and a second auxiliary string passing through the second front auxiliary hole and the second rear auxiliary hole and connecting the second rear string and the second front string.

* * * * *